US007334291B2

(12) United States Patent
Song et al.

(10) Patent No.: US 7,334,291 B2
(45) Date of Patent: Feb. 26, 2008

(54) SUCTION BRUSH ASSEMBLY AND A VACUUM CLEANER HAVING THE SAME

(75) Inventors: Hwa-gyu Song, Gwangju (KR); Hoa-joong Kim, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 223 days.

(21) Appl. No.: 11/013,024

(22) Filed: Dec. 15, 2004

(65) Prior Publication Data

US 2005/0223522 A1 Oct. 13, 2005

(30) Foreign Application Priority Data

Apr. 13, 2004 (KR) ..... 10-2004-0025183
Jul. 23, 2004 (KR) ..... 10-2004-0057754

(51) Int. Cl.
*A47L 9/04* (2006.01)

(52) U.S. Cl. ..... 15/375; 15/326; 15/387; 15/421

(58) Field of Classification Search ..... None
See application file for complete search history.

(56) References Cited

U.S. PATENT DOCUMENTS 5,517,716 A 5/1996 Park
6,161,251 A * 12/2000 Lee et al. ..... 15/379
6,792,648 B2 * 9/2004 Lee ..... 15/377
6,823,558 B2 * 11/2004 Lee ..... 15/391
6,842,941 B2 * 1/2005 Lee ..... 15/385

FOREIGN PATENT DOCUMENTS

| | | |
|---|---|---|
| CN | 1188634 | 7/1998 |
| CN | 1403049 | 3/2003 |
| DE | 4418433 | 12/1994 |
| DE | 19739546 | 3/1998 |
| DE | 10157017 | 3/2003 |
| JP | 6185911 | 1/1986 |
| JP | 64 58224 | 3/1989 |
| JP | 9 28632 | 2/1997 |
| JP | 11009523 | 1/1999 |
| JP | 2004 008785 | 1/2004 |

OTHER PUBLICATIONS

Chinese Office Action and English translation.

* cited by examiner

*Primary Examiner*—David A Redding
(74) *Attorney, Agent, or Firm*—Ladas & Parry LLP

(57) ABSTRACT

A suction brush assembly comprises an assembly body having a suction inlet for drawing in dust on a surface being cleaned, a cover connected to the assembly body and having an opening for drawing in an external air, and a rotation body rotatably mounted to the assembly body and mounting a detachable cleaning member at a lower part thereof for contact with the surface being cleaned. The external air drawn in through the opening flows out to a lower part of the assembly body through a gap formed between the rotation body and the assembly body. Accordingly, the dust can be prevented from flowing into the rotation body, thereby improving an efficiency of a cleaning work.

15 Claims, 6 Drawing Sheets

SUCTION BRUSH ASSEMBLY AND A VACUUM CLEANER HAVING THE SAME

CROSS-REFERENCE TO RELATED APPLICATIONS

This application claims the benefit of Korean Patent Application Nos. 2004-57754 and 2004-25183, filed Jul. 23, 2004, in the Korean Intellectual Property Office, the disclosure of which is incorporated herein by reference.

FIELD OF THE INVENTION

The present invention relates to a suction brush for a vacuum cleaner. More particularly, the present invention relates to a suction brush providing an more-efficient cleaning and reduced noise as well as a vacuum cleaner having the same.

BACKGROUND OF THE INVENTION

FIG. 1 is an exploded perspective view showing a prior art vacuum cleaner. The vacuum cleaner comprises a cleaner body 1 that encloses therein, a motor for driving a fan that generates a suction force. The vacuum cleaner also includes an extension hose 10 connected to the cleaner body 1, and a suction brush assembly 20 connected to the extension hose 10 through which dust on a surface being cleaned is drawn.

The extension hose 10 comprises an extension pipe 14 and an extension pipe connecter 12. A first end of the extension pipe connector 12 is connected to the suction brush assembly 20; the opposite end of the extension pipe connector 12 is connected to an extension pipe 14 that is in turn connected to a suction hose 16. One end of the suction hose 16 is connected to the extension pipe 14; the opposite end of the suction hose 16 is connected to the cleaner body 1.

With the arrangement shown in FIG. 1, dust can be drawn in through the suction brush assembly 20, passed through the extension pipe connecter 12, the extension pipe 14 and the suction hose 16 and finally into the cleaner body 1 where it is collected in a dust collecting chamber (not shown).

The suction brush assembly 20 comprises a cover 22, an assembly body 30 connected to which the cover 22 is attached. The assembly body 30 has a suction inlet 36 at a bottom surface thereof. The assembly body 30 also includes a turbine fan 90 rotatably mounted to the assembly body 30 between two axes 90 and two screw or "worm" drives 72, each of which is operatively coupled to a corresponding worm gear 74.

A rotation body 80 mounts a cleaning member 82 such as a dust cloth at a lower part thereof. The rotation body 80 is rotatably mounted on a rotation body mounting boss 40 of a rotation body receiving space 38 formed on the assembly body 30.

When the motor (not shown) in the cleaner body 1 operates, a suction force is generated at the suction inlet 36 at the bottom of the assembly body 30, thereby drawing in dust-laden air from a surface being cleaned. The drawn-in air collides with a turbine blade 92 provided to the turbine fan 90, thereby causing the turbine fan 90 to rotate. When the turbine fan 90 rotates, the worm drive 72 coaxially formed with the turbine fan 90 is rotated. Since the worm drive 72 is engaged with the worm gear 74, rotation of the worm drive 72 by the turbine fan 90 causes the worm gear 74 to rotate. The driving force transmitted to the worm gear 74 rotates the rotation body 80, thereby causing the cleaning member 82 mounted at a lower part of the rotation body 80 to rotate. Rotation of the cleaning member 82 facilitates dust collection from a surface being cleaned (not shown).

As shown in FIG. 2, as the rotation body 80 of the cleaning member 82 rotates over a surface, dust on the surface tends to be drawn in to the relatively narrow space 200 between a bottom plate 39 of the rotation body receiving space 38 (FIG. 1) and a cleaning member mounting part 84 of the rotation body 80. Drawn-in dust then tends to accumulate between the even narrower space between the rotation body 80 and the rotation body mounting boss 40. Dust also flows into the rotation body receiving space 38 and tends to accumulate on and near the worm drive 72 (FIG. 1) and the worm gear 74 (FIG. 1). Because of dust that accumulates over time, the rotation body 80 begins to be impeded by the accumulated dust. Over time, the cleaning member's rotation body 80 loses its effectiveness and cleaning effectiveness deteriorates.

Moreover, since the distance between the suction inlet 36 and the turbine fan 90 is short, as shown in FIG. 3, noise generated from the turbine fan 90 and other component parts is emitted to the outside of the suction brush assembly 20 through the suction inlet 36. The noise, especially of high frequency region, may be offensive to a user. Thus, there is exists a need for a vacuum cleaner suction brush assembly having a rotating cleaning element or member that is less susceptible to dust accumulation and which reduces noise generation. There also exists a need for a vacuum cleaner having such a suction brush assembly.

SUMMARY OF THE INVENTION

There is provided, a suction brush assembly capable of preventing dust from accumulating in areas where, over time, it can impede the operation of rotating cleaning members, thereby improving a cleaning efficiency, and a vacuum cleaner having the same. The suction brush assembly also produces less noise than do prior art suction brush assemblies.

The suction brush assembly in one embodiment is comprised of an assembly body having a suction inlet for drawing in dust on a surface being cleaned, a cover connected to the assembly body and having an opening for drawing in an external air, and a rotation body rotatably mounted to the assembly body and mounting a detachable cleaning member at a lower part thereof for contact with the surface being cleaned. The external air drawn in through the opening flows out to a lower part of the assembly body through a gap formed between the rotation body and the assembly body.

The suction brush assembly in another embodiment also comprises an assembly body having a suction inlet for drawing in dust from a surface being cleaned; a cover connected to the assembly body; a turbine fan rotatably mounted to the assembly body; a suction path for guiding an air drawn in through the suction inlet to the turbine fan; and a path partition defining the suction path and having a plurality of holes. Inflow of the dust through a gap between the rotation body and the assembly body can be prevented to improve an efficiency of the cleaning work. Further, noise of high frequency, generated form the turbine fan and other component parts can be reduced.

The suction brush assembly according to yet another embodiment of the present invention comprises an assembly body having a suction inlet, a rotation body rotatably mounted to the assembly body and mounting a detachable cleaning member at a lower part thereof for contact with the surface being cleaned, a first cover connected to the assembly body to cover the rotation body and having a first opening for drawing in an external air, and a second cover disposed above the first cover, being connected to the assembly body and having a second opening, a turbine fan rotatably mounted to the assembly body, a worm drive and a worm gear for transmitting a driving force of the turbine fan, a path forming member provided in the assembly body to form a suction path and having a plurality of holes, and a sound-absorbing member mounted to the path forming member to cover the holes.

The external air, drawn in through the first and the second openings as described above, is passed through a gap formed between the rotation body and the rotation body mounting boss of the assembly body and discharged out to a lower part of the assembly body. Therefore, the dust can be prevented from flowing to the rotation body through the gap, and accordingly, the rotation body can smoothly rotated, thereby improving the cleaning efficiency.

In addition, noise generated from the turbine fan and other component parts, especially, the noise of a high frequency region, can be reduced since the noise is absorbed into the sound-absorbing member through the holes while being discharged to the suction inlet through the suction path.

BRIEF DESCRIPTION OF THE DRAWINGS

The above aspect and other features of the present invention will become more apparent by describing in detail exemplary embodiments thereof with reference to the attached drawing figures, wherein.

DETAILED DESCRIPTION OF THE PREFERRED EMBODIMENTS

Figure 1:
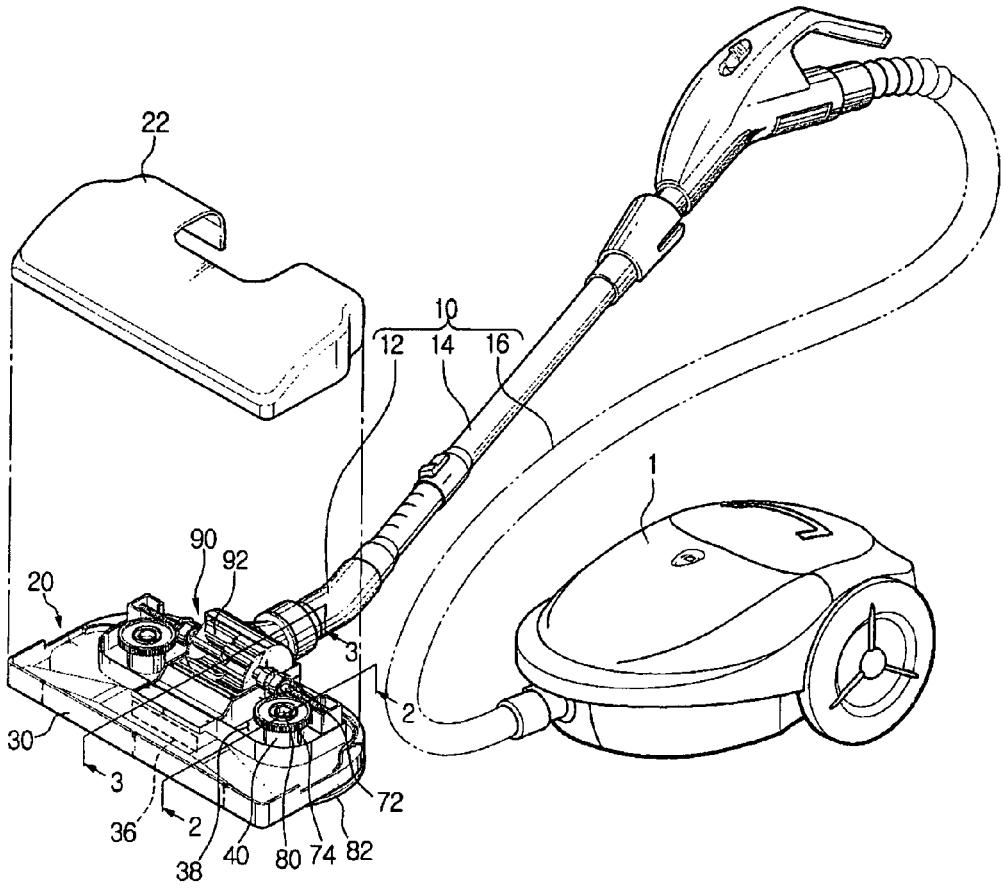
FIG. 1 is an exploded perspective view showing a conventional, prior art vacuum cleaner.
Figure 2:
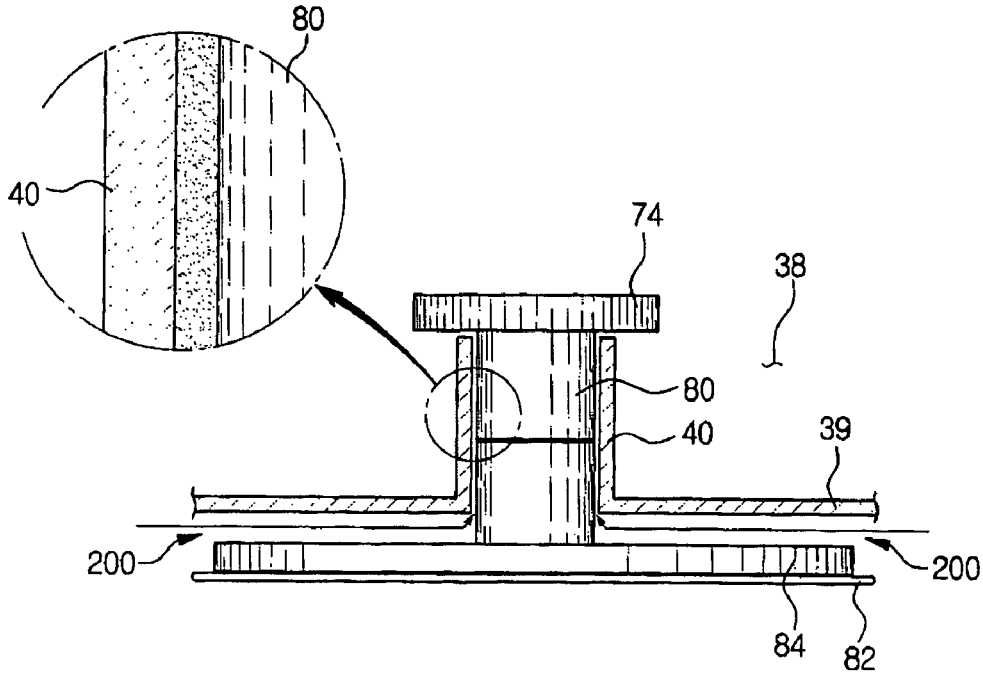
FIG. 2 is a sectional view of the prior art vacuum cleaner shown in FIG. 1, cut along a line 2-2.
Figure 3:
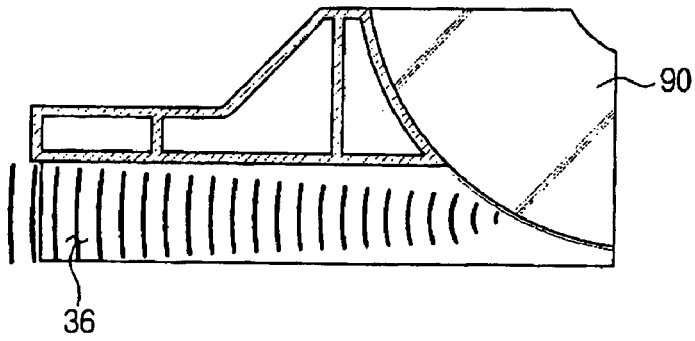
FIG. 3 is a sectional view of a path forming member of the prior art vacuum cleaner shown in FIG. 1 cut along a line 3-3.

Hereinafter, an embodiment of the present invention will be described in detail with reference to the accompanying figures. In the following description, drawing reference numerals are used for the same elements in different drawings. The embodiments described herein are only examples and are not intended to limiting the invention disclosed herein. Rather, the invention disclosed herein is defined by set forth in the appurtenant claims. Also, well-known functions and structures are not described in detail, since they would tend to obscure the claimed invention in unnecessary detail.

Figure 4:
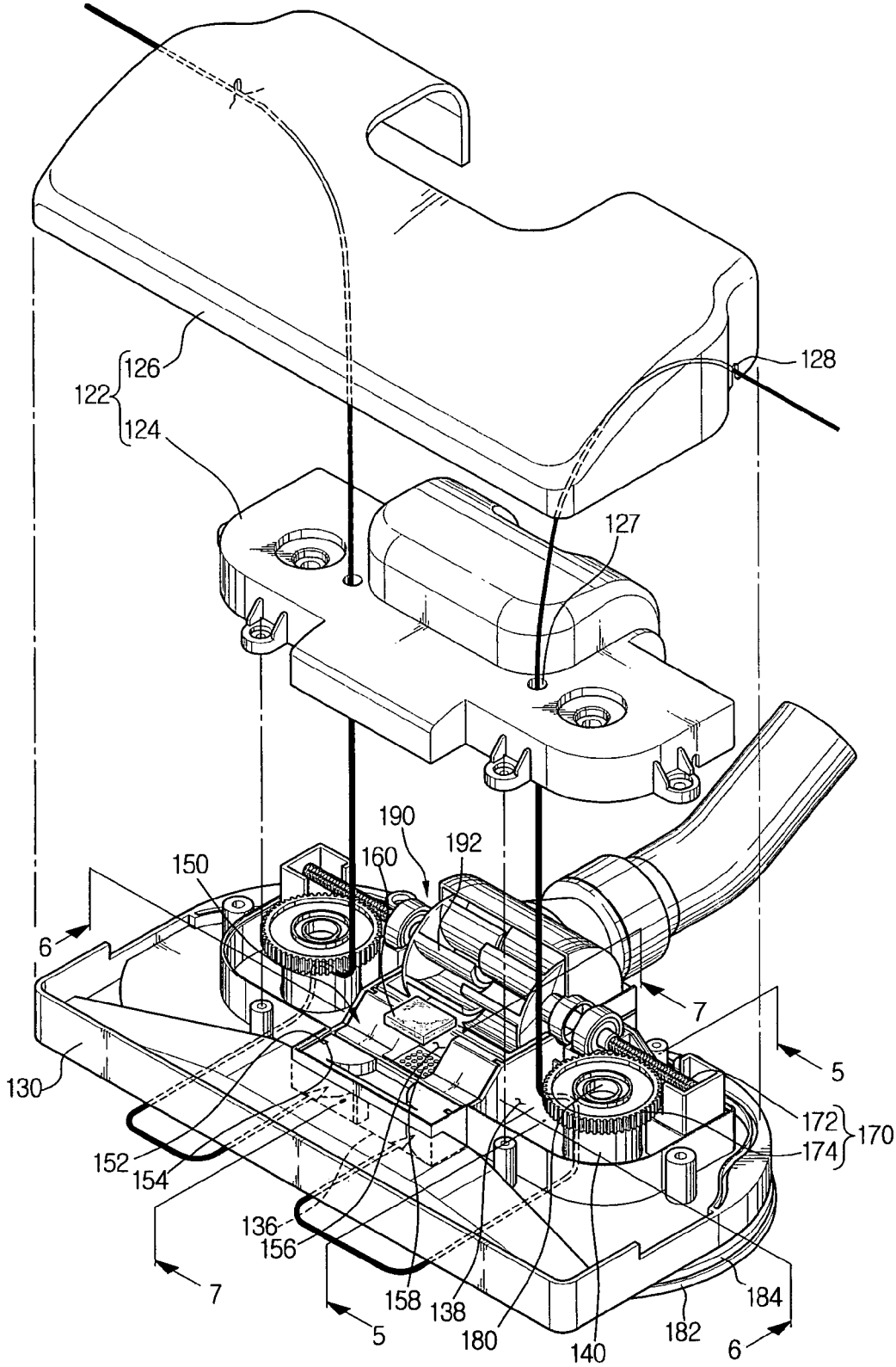
FIG. 4 is an exploded perspective view of a suction brush assembly according to an embodiment of the present invention.

Referring to FIG. 4, a preferred embodiment of a suction brush assembly comprises a two-piece cover 122, a lower assembly body 130 connected to the cover 122 and having a suction inlet 136 at a bottom surface thereof. A turbine fan 190 is rotatably mounted to the assembly body 130. A suction path-forming member 150 is disposed in front of the turbine fan 90 and mounted on the assembly body 130 to direct drawn-in air into the turbine fan 90. A rotation body 180 is rotatably mounted on the assembly body 130 to rotate about its axis by driving force transmitted to it from the turbine fan 190 through a power transmission 170 comprised of a screw or "worm" drive, hereafter referred to as worm 172, the axial rotation of which turns a worm wheel 174. The power transmission 170 therefore receives torque from the turbine fan 190 and delivers it to the rotation body 180.

The two-piece cover 122 comprises a first interior cover 124 connected to the assembly body 130 to enclose and cover the rotation body 180 and the turbine fan 190. A second exterior cover 126 is disposed above the first cover 124 and connected to the assembly body 130.

As shown in FIG. 4, the suction brush assembly has two covers, 124 and 126, both of which have openings for drawing in external air. The first cover 124 has a first opening 127; the second cover 126 has a second opening 128. By way of the first interior cover 124 that is directly covering the rotation body 180 and the turbine fan 190, and by way of the second cover 126 covering the first cover 124, noises generated from the turbine fan 190 and the rotation body 180 is confined to the interior of the suction brush assembly and prevented from being transmitted outside of the suction brush assembly.

Figure 5:
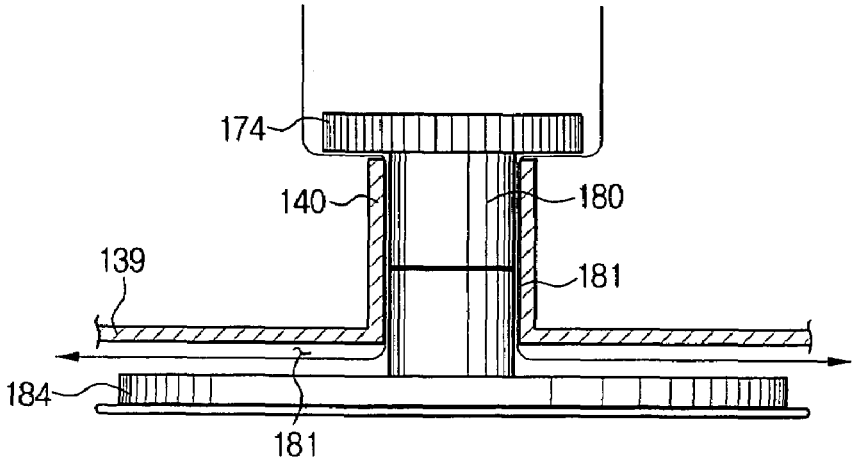
FIG. 5 is a sectional view of FIG. 4 cut along a line 5-5.

The assembly body 130 includes a rotation body receiving space 138 that is sized, shaped and arranged to receive the rotation body 180 and a rotation body-mounting boss 140. As shown in FIG. 4 and FIG. 5, the rotation body mounting boss 140 rotatably mounts the rotation body 180 in the rotation body receiving space 138. Air is drawn into the rotation body receiving space 138 through the first and the second openings 127 and 128.

Referring again to FIG. 4, the turbine fan 190 is rotatably mounted at a rear portion of the assembly body 130 and comprises a plurality of turbine blades 192 which are preferably curved. Air drawn in through the suction inlet 136 ollides with the turbine blades 192, thereby rotating the turbine fan 190.

A groove 154 is formed at both sides of the path-forming member 150. The groove 154, is sized, shaped and arranged to accept a sliding projection 152 that is formed on the assembly body 130 such that the path-forming member 150 is mounted to the assembly body 130 downwardly such that it will slide in the grooves 154. The path forming member 150 is disposed in front of the turbine fan 190 to guide drawn-in air through the suction inlet 136 and into to the turbine fan 190. Since the air path defined by the path-forming member 150 narrows as the distance from the suction inlet 136 increases, the drawn-in air flowing through the path-forming member 150 increases in speed as it approaches the turbine fan 190. The increased speed of air flowing against the turbine fan 190 blades provides the air with an increased momentum, which in turn provides a higher rotatory output power from the turbine fan 190 as the air flow impinges on the turbine fan 190 blades. An increased air speed however, will usually cause an increased noise level. The path-forming member 150 therefore has a sound-absorbing portion 156 for mounting a sound-absorbing member 160 at an upper part thereof. Several holes 158 are formed at a bottom of the sound-absorbing member-mounting portion 156. The holes 158, penetrate the suction path 134 (FIG. 7) and reduce noise emitted to the outside through the suction path 134.

As shown in FIG. 4 and FIG. 5, the rotation body 180 that is rotatably mounted in the rotation body-mounting boss 140 includes a cleaning member mounting portion 184 that is detachably mounted to the cleaning member 182. The cleaning member is preferably embodied as dust-absorbent material commonly known as a dustcloth. The cleaning member 182 rotates with the rotation body 180 by driving force transmitted to it from the turbine fan 190, thereby wiping dust on a surface being cleaned.

As shown in FIG. 1, a gap 181 is formed between the rotation body 180 and the rotation body-mounting boss 140. External air drawn into the rotation body receiving space 138 through the first and the second openings 127 and 128 that are formed at the first and the second covers 124 and 126 flows to a lower part of the assembly body 130 through the gap 181 thereby preventing dust and other small particles from accumulating therein. Air that flows out to the lower part of the assembly body 130 is drawn into the suction inlet 136 where airborne dust can be collected.

The power transmitter 170 transmits torque, i.e., driving force generated by the turbine fan 190 rotation, to the rotation body 180. As mentioned above, the power transmitter 170 comprises a worm 172 having a central axis about which the worm 172 rotates. The worm 172 is coaxial with and forms an extension of the axis of rotation of the turbine fan 190. Spiral flutes that run the length of the worm 172, engage gear teeth on the circumference of the worm wheel 174, which is disposed at an upper part of the rotation body 180 corresponding to the spiral-shaped flutes on the worm 172. While the preferred embodiment of the invention uses a worm and worm wheel, those of ordinary skill in the art will recognize that various power transmission structures and methods may be used to transmit the driving force from the turbine fan 190 to the rotation body 180.

FIG. 5 is a sectional view of FIG. 4 cut along a line 5-5 showing a structure and method for preventing dust from flowing into the rotation body 180.

Referring now to FIG. 5, the external air flowing in through the first and the second openings 127 and 128 (shown in FIG. 4) formed at the first and the second covers 124 and 126 (FIG. 4), flows into the rotation body receiving space 138 by a vacuum in the rotation body receiving space 138. The external air flowing in the rotation body receiving space 138 flows out to the lower part of the assembly body 130, passing through the gap 181 formed between the rotation body mounting boss 140 and the worm wheel 174, between the rotation body mounting boss 140 and the rotation body 180 and between a bottom plate 139 of the rotation body receiving space 138 and the cleaning member mounting portion 184. Because the direction of air flow through the rotation body receiving space 138 is away from annular space between the rotation body 180 and rotation body mounting boss 140 in the direction shown by the arrows 202, air borne dust is less likely to accumulate and impede the rotation of the rotation body, According to this, the dust on the surface being cleaned can be prevented from flowing from the lower part of the assembly body 130 to the rotation body 180, the worm wheel 174 and the worm 172 (FIG. 4) through the gap 181. Therefore, the rotation body 180 can rotate smoothly. Cleaning efficiency and vacuum cleaner efficacy is improved.

Figure 6:
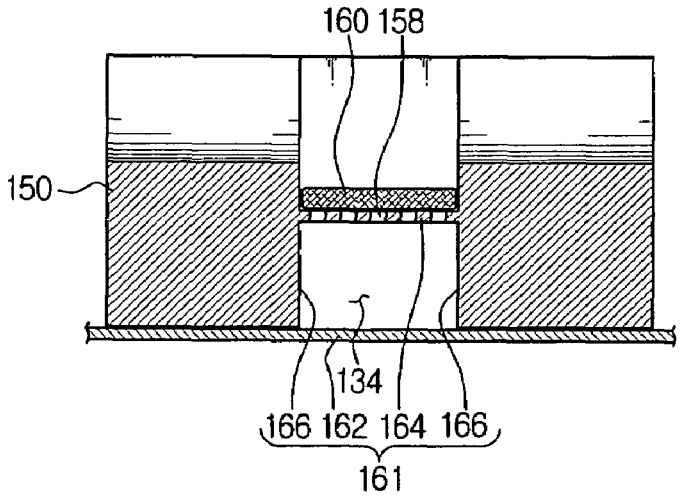
FIG. 6 is a sectional view of a path forming member of FIG. 4, cut along a line 6-6.
Figure 7:
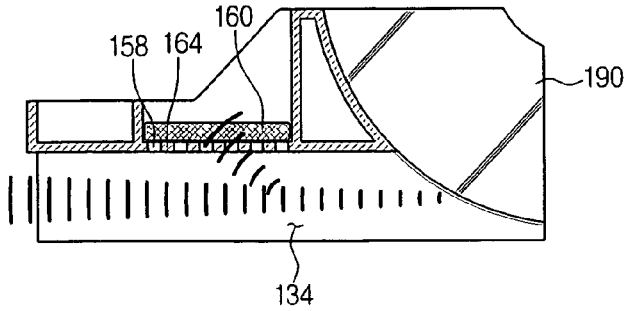
FIG. 7 is a sectional view of a path forming member of FIG. 4, cut along a line 7-7.

FIGS. 6 and 7 are sectional views of the path-forming member 150 of FIG. 4. FIG. 6 is a sectional view of the path-forming member taken along section lines 6-6 in FIG. 4. FIG. 7 is a sectional view taken along section lines 7-7 in FIG. 4.

The suction path 134, which guides the air drawn in from the suction inlet 136 (FIG. 4) to the turbine fan 190, is defined by a path partition 161 formed in the path-forming member 150. The path partition 161 comprises an upper partition 164 forming an upper part of the suction path 134, a side partition 166 forming a side part of the suction path 134, and a bottom plate 162 of the assembly body 130, forming the bottom of the suction path 134. The upper partition 164 has the aforementioned holes 158. The aforementioned sound-absorbing member 160 is mounted on a top surface of the upper partition 164 having the holes 158.

Noise generated from the turbine fan 190 and other parts is transmitted along the suction path 134 and discharged to the outside through the suction inlet 136. The holes 158 formed at the upper partition 164, change air pressure within the suction path 134. Therefore, noise is absorbed by the sound-absorbing member 160 by the holes 158.

Although the sound-absorbing member 160 is employed in the preferred embodiment, an alternate embodiment eliminates the sound-absorbing member 160 and uses only with the holes 158 to abate noise. Furthermore, the holes 158 may be formed on the side partition 166 or the bottom plate 162 of the assembly body 130, other than the upper partition 164.

Figure 8:
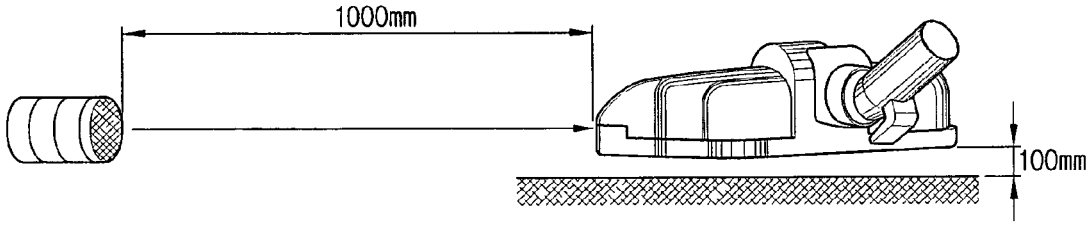
FIG. 8 is a concept view showing the conditions for a noise detection experiment of the suction brush assembly.
Figure 9:
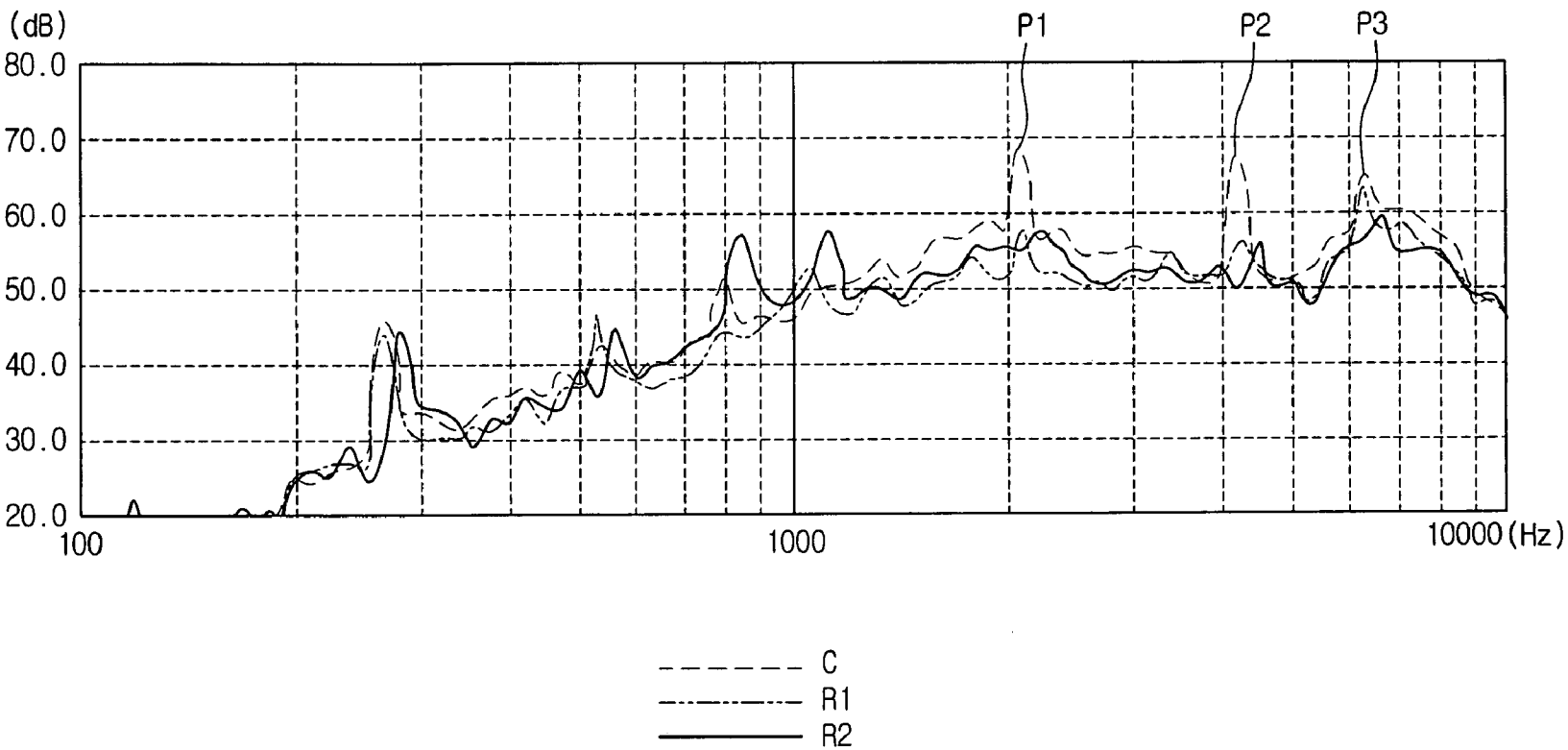
FIG. 9 is a graph showing the experimental results of FIG. 8.

FIG. 8 shows the conditions of an experiment for verifying a sound-reducing effect, the noise of high frequency, of the suction brush assembly, and FIG. 9 is a data graph showing the experimental results of FIG. 8.

Referring to FIG. 8, the vacuum cleaner is driven with the suction brush assembly apart from the surface being cleaned by approximately 100 mm, and a sound pressure is measured at approximately 1000 mm distance from the suction brush assembly. As experimental samples, a suction brush assembly C without the holes 158, a suction brush assembly R1 having the plurality of holes 158 at the upper partition 164, and a suction brush assembly R2 having the plurality of holes 158 at the upper partition 164 and the sound-absorbing member 160 at the top surface of the upper partition 164. A diameter of the hole 158 is approximately 2.3 mm, and the number of the holes 158 employed in this embodiment is 30.

FIG. 9 shows a plot of output noise level as a function of frequency. As shown, the horizontal axis denotes a frequency of the noise generated from the suction brush assembly. The vertical axis denotes the sound pressure in accordance with the frequency. Units for noise frequency and the noise sound pressure are respectively in Hz (hertz) and dB (decibels).

Experimental results are shown in the following table.

| | Peak noise of suction brush assembly | | | Overall |
|---|---|---|---|---|
| Examples | 2113 Hz (P1) | 4216 Hz (P2) | 6336 Hz (P3) | noise |
| C | 68.2 dB | 67.2 dB | 67.2 dB | 73.0 dB |
| R1 | 57.9 dB | 55.8 dB | 63.2 dB | 70.0 dB |
| R2 | 57.5 dB | 55.6 dB | 60.0 dB | 69.6 dB |

The peak noise in the above table refers to a relatively higher value (usually over 7 dB) than the peripheral frequency. Peak noise sounds are generally most offensive to a user. The peak noises, illustrated as P1, P2 and P3 in FIG. 6A, are considerably reduced in the example R1, which has only the holes 158. In the example R2, which is provided with the additional sound-absorbing member 160 at the upper partition 164 having the holes 158, the peak noise is more reduced.

The entire noise level in the above table refers to an integrated value of the entire frequency range shown in FIG. 9. In the example R1, having only the holes 158, the overall noise is reduced by approximately 3 dB. In the example R2, which uses the sound-absorbing member 160 and the holes 158, sound-reducing effect is improved.

Consequently, by providing the holes 158 in the suction path 134, the noise of the suction brush assembly can be reduced. Noise is reduced even further by providing the sound-absorbing member 160. The noise of high frequency, especially the peak noise in the high frequency region, to which users react more sensitively, is more markedly reduced.

As can be appreciated from the above description, according to the suction brush assembly according to an embodiment of the present invention and the vacuum cleaner having the same, the external air, which is guided into the rotation body receiving space 138 through the openings 127 and 128 formed on the covers 124 and 126, flows out to the lower part of the assembly body 130 through the gap 181 formed between the rotation body 180 and the rotation body mounting boss 140. Therefore, the dust on the surface being cleaned can be prevented from flowing into the rotation body 180 and the power transmitter 170. As a result, the operation of the rotation body 180 is smoothly performed, thereby improving the efficiency of the cleaning work.

Furthermore, by employing the holes 158 in the suction path 134, and the sound-absorbing member 160 over the holes 158, the noise generated from the suction brush assembly, especially, the peak noise in the high frequency region, which is very offensive to the user, can be reduced.

While the invention has been shown and described with reference to certain embodiments thereof, it will be understood by those skilled in the art that various changes in form and details may be made therein without departing from the spirit and scope of the invention as defined by the appended claims.

What is claimed is:

1. A suction brush assembly comprising:

an assembly body having a suction inlet for drawing in dust on a surface being cleaned;

a cover connected to the assembly body and having an opening for drawing in an external air; and a rotation body rotatably mounted to the assembly body and mounting a detachable cleaning member at a lower part thereof into contact with the surface being cleaned; and said assembly body, cover, rotation body and cleaning member constructed and arranged so that external air drawn in through the opening flows out a lower part of the assembly body toward the floor through a gap formed between the rotation body and the assembly body.

2. The suction brush assembly of claim 1, further comprising:

a turbine fan rotatably mounted on the assembly body; and a power transmitter connected to the turbine fan to transmit a driving force to the rotation body.

3. The suction brush assembly of claim 2, wherein the power transmitter comprises a worm coaxially formed with the turbine fan and a worm wheel formed at an upper part of the rotation body to correspond to the worm.

4. The suction brush assembly of claim 1, wherein the cover comprises a first cover connected to the assembly body to cover the rotation body and a second cover disposed above the first cover, being connected to the assembly body, and the first and the second covers respectively have an opening.

5. The suction brush assembly of claim 1, wherein the assembly body is further comprised of:

a path partition defining a suction path through the assembly body, said path partition having a plurality of holes; and wherein, said rotation body rotatably mounted to the assembly body is comprised of a cleaning member that rotates with the rotation body to wipe dust from a surface being cleaned.

6. The suction brush assembly of claim 5, wherein the path partition further comprises an upper partition forming an upper part of the suction path, said holes being formed on the upper partition.

7. The suction brush assembly of claim 6, wherein the assembly body further comprises a sound-absorbing member.

8. The suction brush assembly of claim 6, wherein the assembly body further comprises a sound-absorbing member, provided at a top surface of the upper partition.

9. The suction brush assembly of claim 7, wherein the sound-absorbing member reduces noise signals from the suction brush assembly that are above 2113 Hz., by more than three (3) decibels (3 db).

10. A vacuum cleaner comprising:

a cleaner body including therein a suction force generator; and a suction brush assembly as claimed in claim 1.

11. The vacuum cleaner of claim 10, wherein the suction brush assembly is further comprised of:

a path partition defining a suction path through the assembly body, said path partition having a plurality of holes; and wherein, said rotation body rotatably mounted to the assembly body is comprised of a cleaning member that rotates with the rotation body to wipe dust from a surface being cleaned.

12. The vacuum cleaner of claim 11, wherein the suction brush assembly is further comprised of:

an upper partition forming an upper part of the suction path, said holes being formed on the upper partition.

13. The vacuum cleaner of claim 12, wherein the suction brush assembly further comprises: a sound-absorbing member.

14. The vacuum cleaner of claim 12, wherein the suction brush assembly further comprises: a sound absorbing member, provided at a top surface of the upper partition.

15. The suction brush assembly of claim 13, wherein the sound-absorbing member reduces noise signals from the suction brush assembly that are above 2113 Hz., by more than three (3) decibels (3 db).

* * * * *